US006006445A

United States Patent [19]

Large

[11] Patent Number: 6,006,445

[45] Date of Patent: Dec. 28, 1999

[54] WASHER/DRYER COMBINATION

[76] Inventor: Ronald D. Large, 6515 Fullerton Ave., Cleveland, Ohio 44105

[21] Appl. No.: 09/146,029

[22] Filed: Sep. 3, 1998

[51] Int. Cl.[6] ..... F26B 11/02

[52] U.S. Cl. ..... 34/609; 34/604

[58] Field of Search ..... 34/604, 606, 607, 34/608, 609, 610

[56] References Cited

U.S. PATENT DOCUMENTS

| | | | |
|---|---|---|---|
| 2,057,259 | 10/1936 | Wolff . | |
| 2,126,426 | 8/1938 | Traube . | |
| 3,247,690 | 4/1966 | Kahn . | |
| 4,270,281 | 6/1981 | Müller . | |
| 4,757,699 | 7/1988 | Arreghini et al. . | |
| 5,029,458 | 7/1991 | Obata et al. . | |
| 5,074,131 | 12/1991 | Hirose et al. . | |
| 5,111,673 | 5/1992 | Kadoya et al. . | |
| 5,121,615 | 6/1992 | Yu . | |
| 5,123,176 | 6/1992 | Yamada et al. . | |
| 5,279,047 | 1/1994 | Janecke | 34/78 |
| 5,317,816 | 6/1994 | Kadakia | 34/603 |
| 5,537,761 | 7/1996 | Oh . | |
| 5,718,130 | 2/1998 | Kim . | |

*Primary Examiner*—Henry Bennett
*Assistant Examiner*—Malik N. Drake
*Attorney, Agent, or Firm*—Fay, Sharpe, Fagan, Minnich & McKee, LLP

[57] ABSTRACT

A washer/dryer combination used for washing and drying articles such as clothing in the same machine. The washer/dryer combination includes a body having a treatment chamber defined within the body, a front side including an opening, and a door attached to the front side and selectively covering the opening. The door includes a front wall, a back wall, a cavity defined between the walls, and a pair of air ducts disposed within the cavity. A first air duct includes a hot air outlet and the second air duct includes an exhaust air inlet. The washer/dryer combination further includes a heater and blower unit for blowing hot air into the chamber of the body via the hot air outlet. A first air conduit has a first end matingly engaging the heater and blower unit and a second end matingly engaging the first air duct. A second air conduit has a first end and second end where the first end matingly engages the second air duct. The washer/dryer combination can further include a lint guard disposed within the second air conduit. At least one seal is provided between the door and the opening of the front side of the body.

18 Claims, 6 Drawing Sheets

WASHER/DRYER COMBINATION

BACKGROUND OF THE INVENTION

The present invention relates generally to laundry machines. More particularly, the present invention relates to an improved washer/dryer combination for use in the washing and drying of clothes, bed sheets, towels and other articles.

As is well known, a washing machine is an appliance for separating dirt from articles to be washed, such as clothing, by sequentially carrying out various operations such as liquid feeding, washing, rinsing, dehydrating, and draining cycles. Generally, the washing machine has an outer tub for receiving a washing liquid and a spin tub accommodated in the outer tub for holding the articles to be washed.

While the washing cycle is being executed, a pulsator, which is driven by a motor, generates a swirling liquid in the spin tub, so the articles which are placed in the spin tub are washed by means of the swirling liquid.

In addition, while the dehydrating cycle is being executed, the motor rotates the spin tub, so the articles are forced toward a side wall of the spin tub due to a centrifugal force. Accordingly, the washing liquid contained in the articles is drained out of the washing machine through discharging holes which are formed in the side wall of the spin tub.

Recently, washing machines have been designed which not only wash the articles but can also dry them. These kinds of washing machines, which are called washing/drying machines, are advantageous for a number of reasons. They can reduce drying time and do not require a separate location for drying the articles. These machines save time and effort for the user. Clothing and other articles do not need to be washed in one machine then removed and loaded into a separate machine for drying. Perhaps just as importantly, a combination washer/dryer is advantageous from the standpoint of a laundromat since each machine can perform either function thus allowing more machines to be in use at one time.

Several washer/dryer combination designs are known. One such device is shown in U.S. Pat. No. 5,718,130. This device is a washing/drying machine which employs a top-loading spin tub rotating around a vertical axis. A blower is mounted on the base portion of the spin tub and blows heated air upwardly so as to direct the heated air toward the side wall of spin tub and onto articles placed in the spin tub.

A disadvantage of this device is that it does not employ a hot air outlet in the door which would allow hot air to be blown directly on the articles for drying. Another disadvantage of this device is that it is not a front-loading machine, thus, reducing its capacity.

Another known device is shown in U.S. Pat. No. 5,121,615. This device is a front-loading combination washer/dryer which includes a housing with a perforated drum disposed in the housing to ensure that all the hot air enters the rotatable drum. The device provides a drying device to be used in conjunction with a washing machine. A stationary drum positioned around the rotatable drum prevents hot air from escaping from the housing of the drying device without entering the rotatable drum so as to dry clothes. A plurality of circumferentially spaced ribs extend from the outer surface of the perforated wall toward the stationary drum, dividing the clearance between the two drums into several isolated chambers.

A disadvantage of this device is that it needs additional components to ensure that all of the hot air enters the drying chamber. Another disadvantage of this machine is that the door is not employed as either a hot air inlet or an exhaust outlet.

Still another known device is shown in U.S. Pat. No. 5,111,673. This device is a washing-drying machine which has a tub mounted in a prism-shaped housing by a pair of tilting shafts in order to carry out the washing-rinsing-spinning steps while the tub is in a substantially vertical orientation and to carry out the warm-air drying step with the tub in a substantially horizontal orientation. The tilting shafts are arranged on a horizontal axis extending through diagonally opposite corners of the housing so that the capacity of the tub can be maximized, even though the tub tilts.

A disadvantage of this device is that it requires tilting of the tub from a vertical axis for washing to a horizontal axis for drying. This construction obviously adds to the complexity of the machine, and hence, its cost.

Yet another known device is shown in the U.S. Pat. No. 5,074,131. The device is a washing/drying machine capable of effecting washing and drying as a continuous process. Washing, rinsing, dehydrating and drying are performed while a rotary basket is retained in a vertical position. After the dehydration, the rotary basket is inclined and is rotated on its axis, so that an opening end of the rotary basket is located slightly higher than the horizontal. In this state, hot air for drying is blown into the rotary basket from the opening side.

A disadvantage of this device is that it requires tilting of the rotary basket axis to switch the machine from the washing phase to the drying phase. Such tilting would not be necessary if the machine were simply a front-loading washer employing a basket which rotates on a horizontal axis.

A further known device is shown in U.S. Pat. No. 5,029,458. This device is a washing and drying machine which has a drum mounted in an outer tank for rotation about a substantially horizontal axis and a reversible motor operable at a fixed speed for driving the drum. During washing and drying operations, the direction of rotation of an output shaft of the motor is switched in short periods while a speed-changing device transmits the rotation of the output shaft of the motor to the drum axle at a reduced speed. During dehydration, the motor operates unidirectionally and the speed-changing device transmits the unidirectional rotation of the motor output shaft to the drum axle with a speed reduction in an initial stage of the dehydration operation and, thereafter, without speed reduction.

A disadvantage of this device is that it is complex and requires the changing of the speed of the output shaft of a motor between dehydration and drying stages. The machine is also a top loader, limiting its capacity.

A still further known device is shown in U.S. Pat. No. 4,757,699. This device is a washing machine which includes a wash tub, a basket for receiving laundry and mounted for rotation within the wash tub, and heater elements which are located within the chamber to thereby heat the washing liquid discharged into the chamber. The device further includes an air drying circuit whereby air is recirculated through an air duct by means of a fan from the bottom of the wash tub to the chamber. The recirculated air is heated by the heating elements.

While this machine appears to have a tub rotating around a horizontal axis, there does not appear to be any mention of the door of the machine. Certainly, there is no mention of employing an aperture in the door either for blowing hot air on the articles or for venting exhaust air from the machine.

Another known device is shown in U.S. Pat. No. 4,270,281. This device is a washing and drying machine having a perforated drum rotatable with a liquid container having, in its upper portion, a recess in which is disposed a heat-register or heating element and a reflector providing for direct irradiation of the drum.

A disadvantage of this device appears to be that it requires the heating element to be disposed within the drum, thus exposing the heating element to detergent in the washing liquid, possibly comprising its longevity.

Accordingly, it has been considered desirable to develop a new and improved washer/dryer combination which would overcome the foregoing difficulties and others while providing better and more advantageous overall results.

BRIEF SUMMARY OF THE INVENTION

The present invention relates to a washer/dryer combination for use with washing and drying clothes and other articles. In a preferred embodiment, the washer/dryer combination comprises a body comprising a top end, a bottom end, a front side, a back side, a left side, a right side, and a treatment chamber defined within the body. The front side includes an opening. The washer/dryer combination further includes a door attached to the front side which selectively covers the opening. The door comprises a front wall, a back wall, and a cavity defined between the front wall and the back wall. The door further includes a pair of air ducts disposed within the cavity. The first air duct includes a hot air outlet, and the second air duct includes an exhaust air inlet.

The washer/dryer combination can be further comprised of a heater and blower unit for blowing hot air into the chamber of the body via the hot air outlet. The heater/blower unit is disposed within the body. If desired, the heater and blower unit can be disposed at the top of the body.

If desired, the washer/dryer combination can further comprise a first air conduit having a first end and a second end. The first air conduit is disposed within the body. The first end matingly engages the heater and blower unit and the second end matingly engages the first air duct of the door.

Further, the washer/dryer combination can include a second air conduit having a first end and a second end. The second air conduit is disposed within the body. The first end of the second air conduit matingly engages the second air duct in the door.

Further, the washer/dryer combination can further comprise a lint guard disposed within the second air conduit.

The washer/dryer combination can also include at least one seal provided between the door and the opening of the front side of the body.

In a second preferred embodiment, the washer/dryer combination comprises a body including a plurality of walls enclosing a treatment chamber. One of the walls includes a first opening and a second opening, where the second opening communicates with the treatment chamber. The washer/dryer combination further includes a door attached to another of the plurality of walls and selectively covering the first opening. The door comprises a third opening disposed within the door. The third opening communicates with the treatment chamber.

If desired, the second opening of the one of the walls includes an exhaust air inlet communicating with the treatment chamber. Alternately, the second opening of one of the walls can include an exhaust air inlet communicating with the treatment chamber.

Further, the third opening in the door further includes a hot air outlet in communication with the treatment chamber. Alternately, the third opening in the door further includes a hot air outlet in communication with the treatment chamber.

The washer/dryer combination further comprises a heater and blower unit for blowing hot air into the chamber of the body via the hot air outlet. The heater and blower unit are disposed within the body.

Further, the washer/dryer combination can further comprise an air conduit having a first end and a second end. The air conduit is disposed within the body. The first end of the air conduit matingly engages the third opening in the door.

One advantage of the present invention is the provision of a washer/dryer combination having a door attached to a front side of a housing and selectively covering an opening in the housing. If desired, the door can have a pair of air ducts disposed within a cavity formed by front and rear walls of the door.

Another advantage of the present invention is the provision of a washer/dryer combination having a door which includes a first air duct including a hot air outlet and a second air duct including an exhaust air inlet. The hot air outlet and exhaust air inlet communicate with the open end of a treatment tub which is mounted for rotation about a horizontal axis.

Yet another advantage of the present invention is the provision of a washer/dryer combination having a heater and blower unit for blowing hot air directly into a rotating treatment tub via a hot air outlet that can be located in a door. This design is advantageous because it more completely utilizes the hot air to dry the articles in the treatment tub, resulting in faster drying of the articles as they are tumbling in the rotating treatment tub.

Still another advantage of the present invention is the provision of a washer/dryer combination having a first air conduit including a first end matingly engaging a heater and blower unit and a second end matingly engaging an air duct which opens into a treatment chamber in a housing of the washer/dryer.

A further advantage of the present invention is the provision of a combination washer/dryer machine having a wall with an opening that communicates with a treatment chamber defined in the machine and a door with an opening that also communicates with the treatment chamber. One of the openings in the wall and in the door can be an exhaust air inlet and the other can be a hot air outlet.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, the preferred embodiments of which will be described in detail in this specification and illustrated in the accompanying drawings which form a part hereof and wherein.

DETAILED DESCRIPTION OF THE PREFERRED EMBODIMENTS

Figure 1:
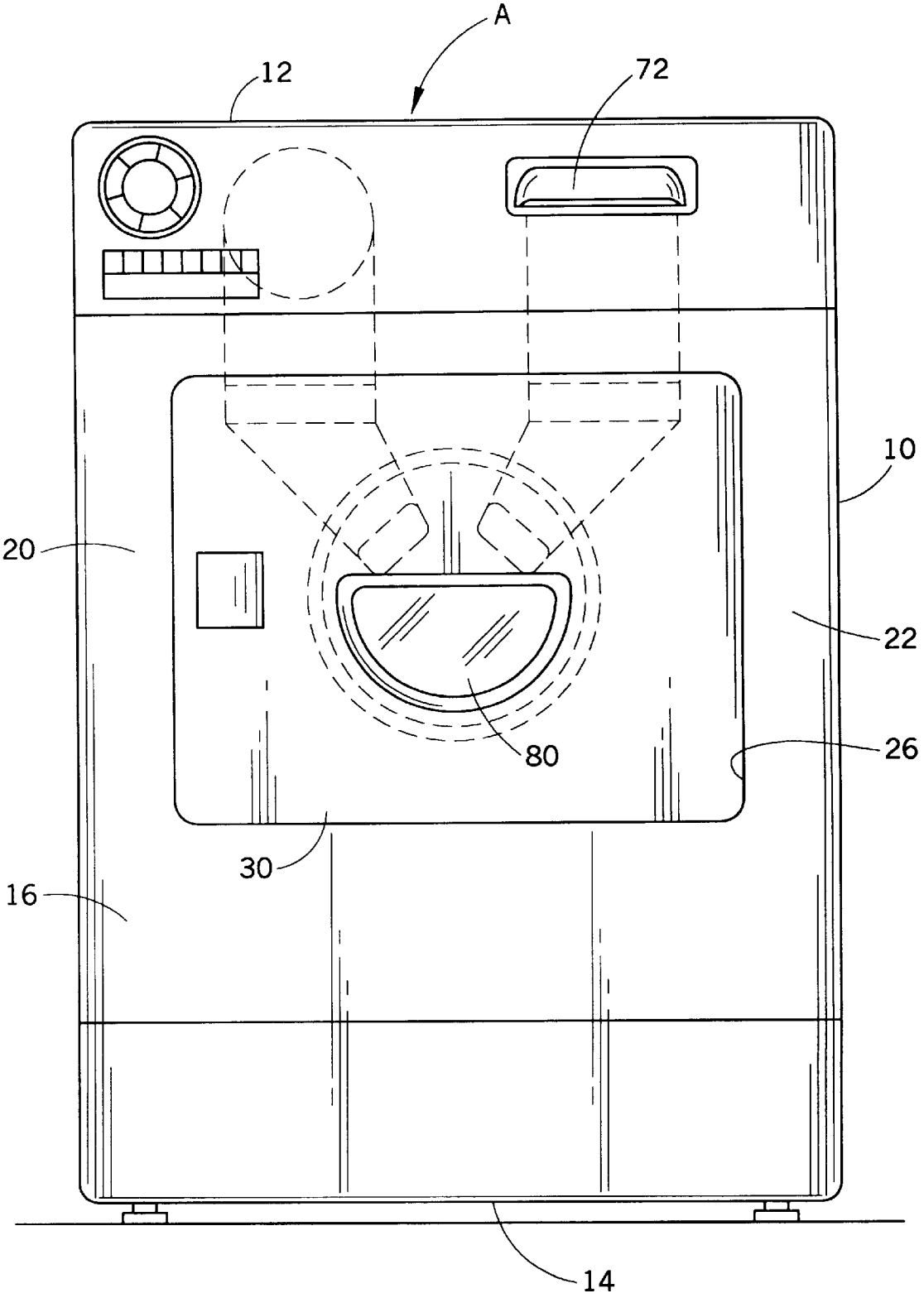
FIG. 1 is a front elevational view of a washer/dryer combination in accordance with a first preferred embodiment of the present invention.

Referring now to the drawings, wherein the showings are for purposes of illustrating the preferred embodiments of this invention only and not for purposes of limiting same, FIG. 1 shows a washer/dryer combination A according to a first preferred embodiment of the present invention. The washer/dryer combination A can be used to wash and dry articles such as clothing, bed linens, towels and the like in the same machine.

As shown in FIG. 1, the washer/dryer combination A preferably has a body 10 including a top end 12, a bottom end 14, a front side 16, a back side 18 (FIG. 5), a left side 20, a right side 22, and a treatment chamber 24 (FIG. 4) defined within the body 10. The front side 16 includes an opening 26.

Figure 2:
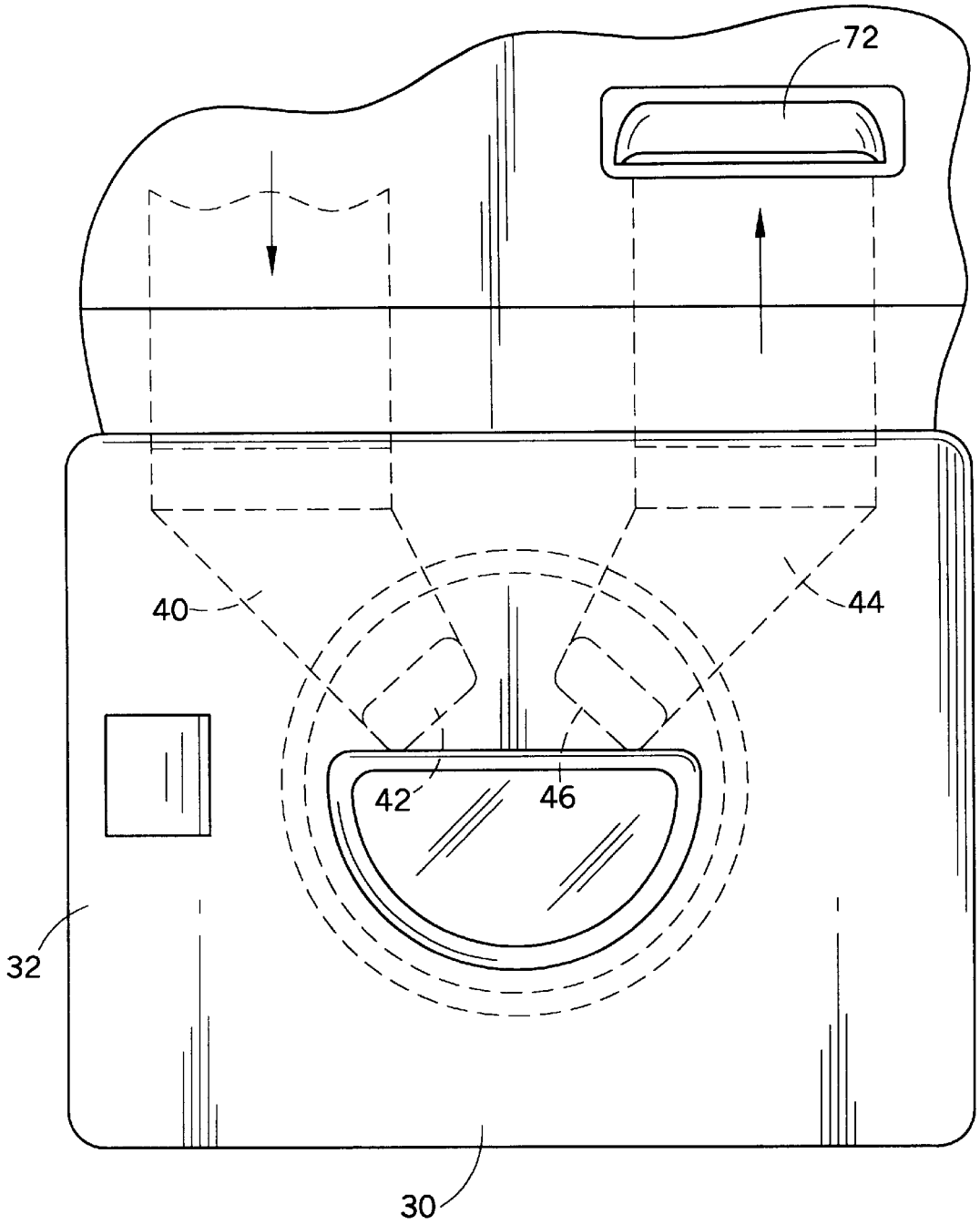
FIG. 2 is an enlarged front elevational view of the door of the washer/dryer combination of FIG. 1.
Figure 3:
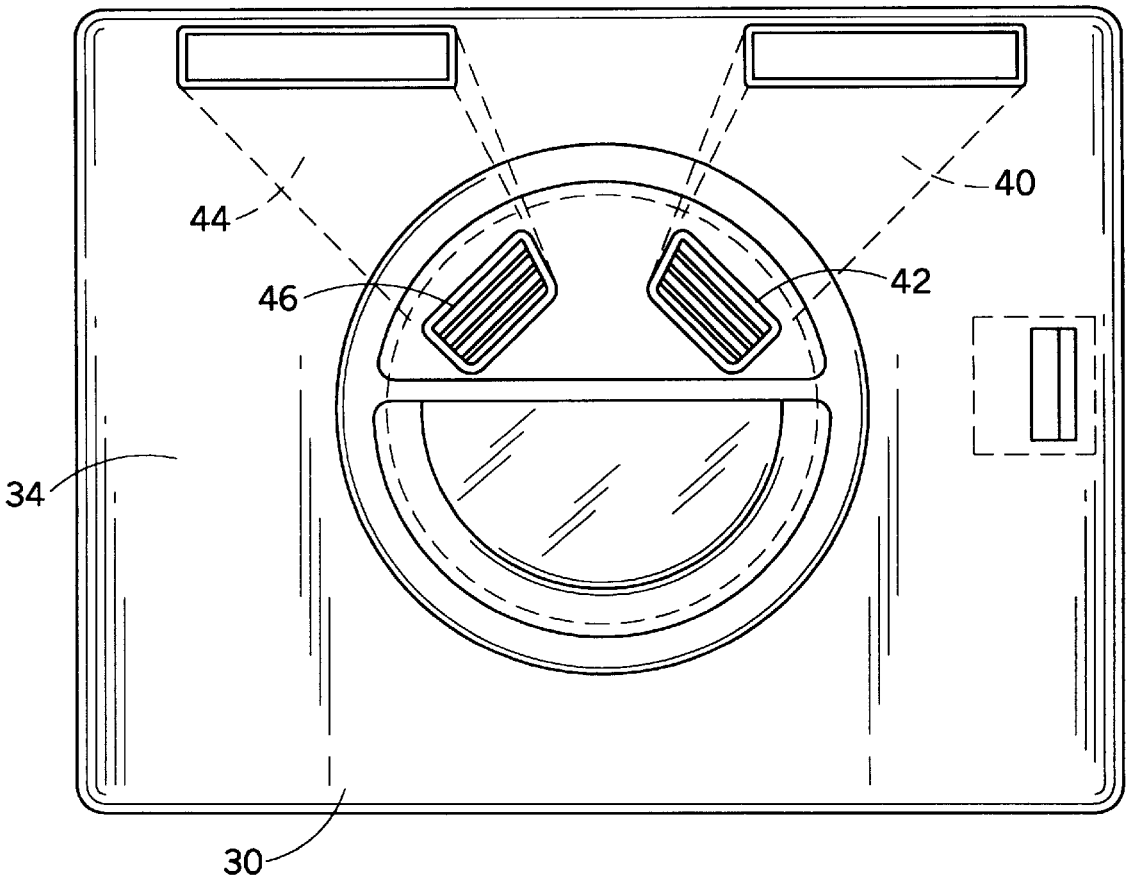
FIG. 3 is a rear elevational view of the door of FIG. 2.
Figure 4:
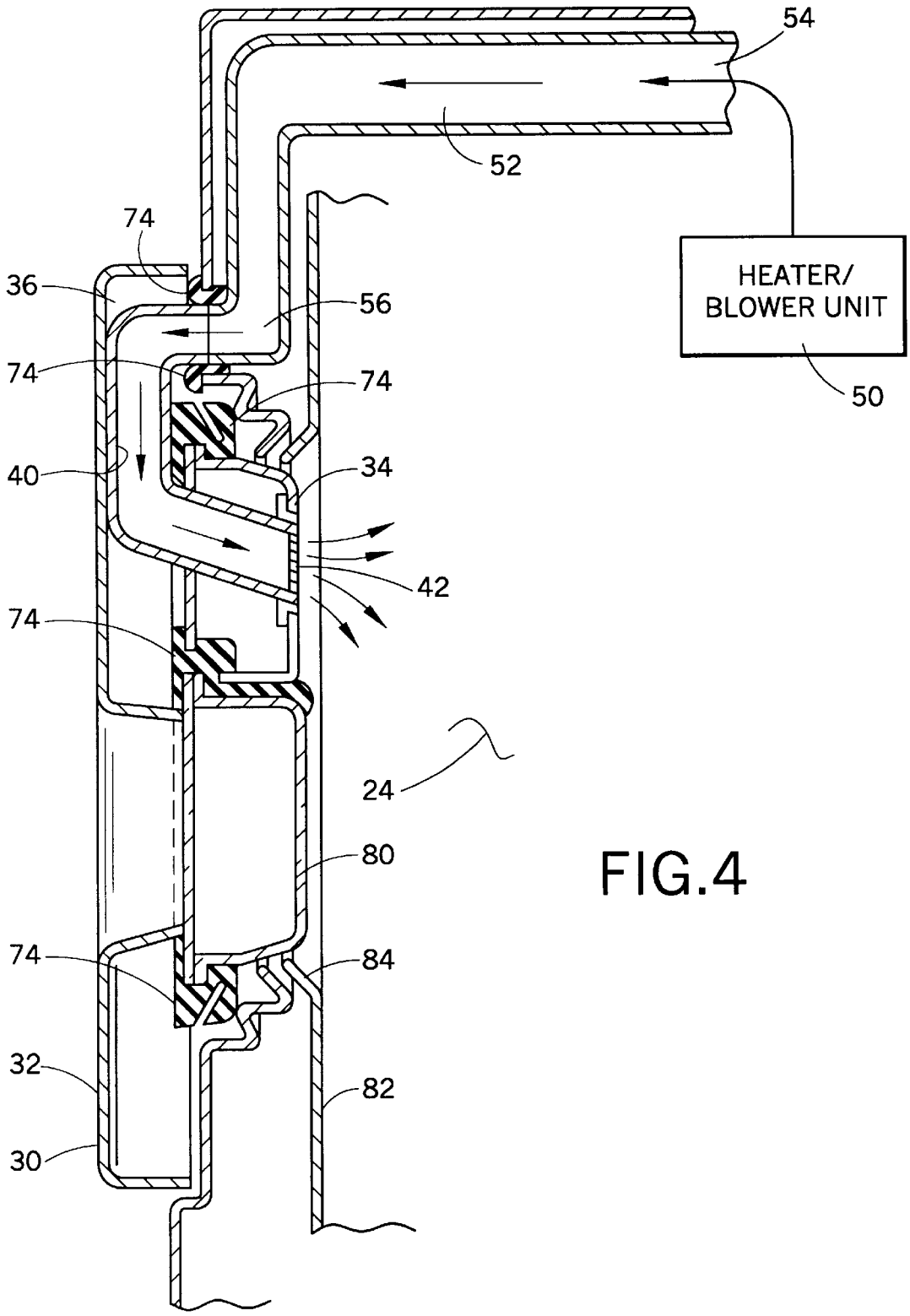
FIG. 4 is an enlarged side elevational view in cross section of the door of FIG. 2 illustrating a first air conduit.

A door 30 is attached to the front side 16 and selectively covers the opening 26. As shown in FIG. 2, the door 30 includes a front wall 32. As shown in FIG. 3, the door 30 further includes a back wall 34. With reference now to FIG. 4, the door 30 further includes a cavity 36 which is defined between the front wall 32 and the back wall 34.

Figure 5:
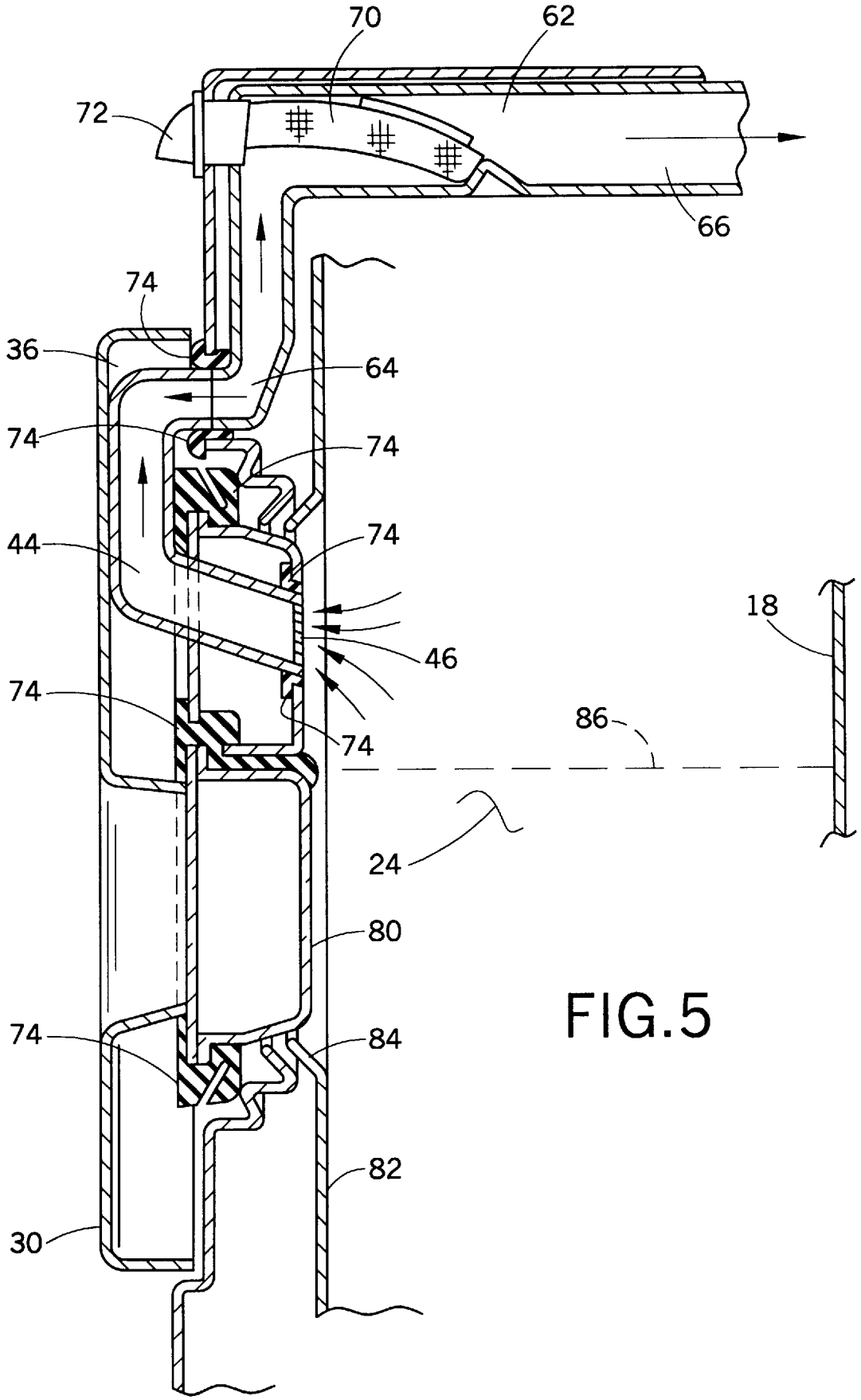
FIG. 5 is an enlarged side elevational view in cross section of the door of FIG. 2 illustrating a second air conduit; and, FIG. 6 is a front elevational view of a washer/dryer combination in accordance with a second preferred embodiment of the present invention.

A first air duct 40 is disposed within the cavity 36. The first air duct 40 includes a hot air outlet 42 defined on the door back wall 34. Referring now to FIG. 5, a second air duct 44 is disposed within the cavity 36 in a manner spaced from the first air duct 40. As is evident from FIG. 2, the two air ducts are arranged in a side-by-side manner. The second air duct 44 includes an exhaust air inlet 46 located on the door back wall. If preferred, the hot air outlet 42 and the exhaust air inlet 46 can each include vents or louvers (not shown) to direct the flow of hot air blown into the treatment chamber 24 through the hot air outlet 42 away from the exhaust air inlet 46 so that the air is not immediately sucked into the exhaust air inlet 46 when entering the treatment chamber 24. It is apparent from FIG. 3 that the hot air outlet 42 and exhaust air inlet 46 are spaced from each other.

Referring again to FIG. 4, the washer/dryer combination further includes a conventional heater and blower unit 50 for blowing the hot air into the treatment chamber 24 through the hot air outlet 42. The heater and blower unit 50 is disposed within the body 10. If desired, the heater and blower unit 50 can be located in the top end of the body 10.

A first air conduit 52 disposed within the body 10 includes a first end 54 and a second end 56. The first end 54 matingly engages the heater and blower unit 50. The second end 56 matingly engages an end of the first air duct 40 located in the door 30.

As shown in FIG. 5, a second air conduit 62, disposed within the body 10, includes a first end 64 and a second end 66. The first end 64 matingly engages an end of the second air duct 44 located in the door 30. The second end 66 matingly engages an exhaust system (not shown) located within the body 10.

Accommodated in the second air conduit 62 is a lint guard 70. Preferably, the lint guard 70 includes a handle 72 which protrudes through an opening in the front side 16 of the body 10 as shown in FIG. 1. In this way, the lint guard can be readily removed from the body 10 and lint can be easily removed from the lint guard.

Referring again to FIGS. 4 and 5, the washer/dryer combination further includes a number of seals 74 which are provided between the door 30 and the opening 26 of the front side 16 of the body 10. Seals are also provided between a window 80 and the front and back walls 32, 34 of the door to prevent fluid in a treatment tub 82 from leaking out through the door. It should be noted that both the hot air outlet 42 and the exhaust air inlet 46 are located within a loading opening 84 of the treatment tub 82. Also, both the outlet 42 and the inlet 46 are located above the rotational axis 86 of the treatment tub 82 to retard the splashing of liquid into these two openings. However, any liquid which does enter these openings can flow out again by gravity due to the shape and orientation of the openings.

Figure 6:
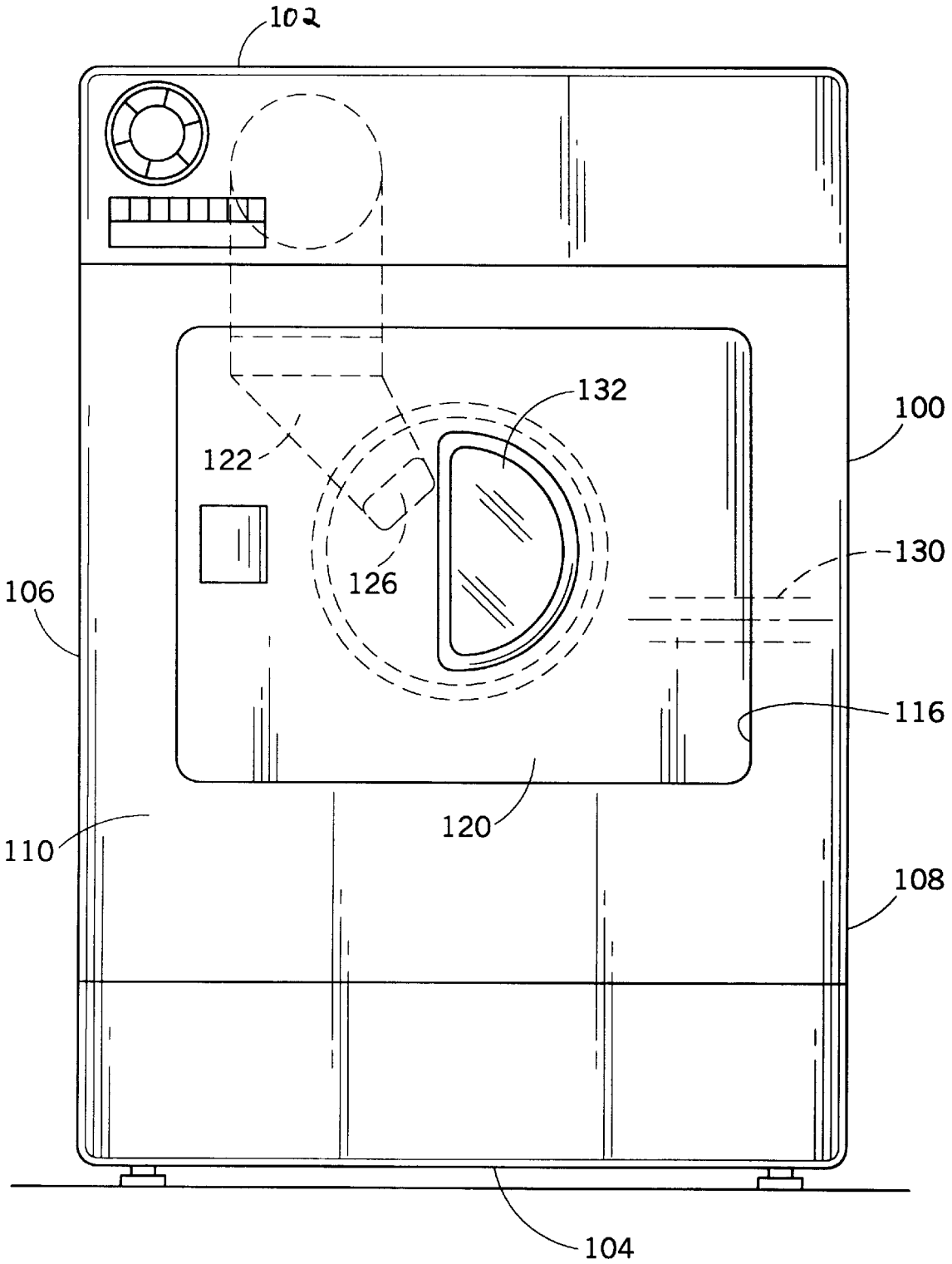

A second preferred embodiment of the washer/dryer combination is shown in FIG. 6. In this embodiment the washer/dryer combination includes a body 100 which includes a plurality of walls 102, 104, 106, 108, 110. The walls together form a treatment chamber. A front wall 110 includes a first opening 116 therein. The first opening 116 communicates with the treatment chamber.

A door 120 is attached to the front wall 110 and selectively covers the first opening 116. Provided in the door 120 is a conduit 122 which communicates with the treatment chamber via an opening 126 at one end of the conduit 122. The opening 126 is located within a loading opening of a treatment tub. The opening 126 is also located above the rotational axis of the treatment tub to retard splashing of liquid into the opening 126. Any liquid which does enter the opening can flow out again by gravity due to the shape and orientation of the opening 126.

A second opening 130 is located on another one of the walls in a manner spaced from the first opening 116. In FIG. 6, the second opening 130 is shown as being located on a left side wall 108 of the body 100. However, it should be appreciated that the second opening 130 could be located on any desired wall of the body 100. The second opening 130 communicates with the treatment chamber located in the body 100. In this embodiment, one of the second opening 130 and the conduit opening 126 can serve as an exhaust air inlet and the other opening can serve as a hot air outlet of the treatment chamber.

A window 132 is located adjacent the opening 126 to allow observation of articles being treated in the treatment chamber. In this embodiment, the window 132 is vertically oriented so that the entire height of the treatment chamber can be observed. It should be noted that the opening 126 can be located in the door above the loading opening of the treatment tub, thus allowing a window 132 which can be the size of the entire loading opening.

The second embodiment can further include a heater and blower unit (not shown) for blowing hot air into the treatment chamber through the hot air outlet. The second embodiment can also include one or more seals (not shown) between the door 120 and the first opening 116.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the present invention, it is now claimed:

1. A washer/dryer combination comprising:

a body comprising a top end, a bottom end, a front side, a back side, a left side, a right side, a treatment chamber defined within said body, said front side including an opening;

a door attached to said front side and selectively covering said opening, said door comprising:

a front wall, a back wall, and a cavity defined between said front wall and said back wall; and, a pair of air ducts disposed within said cavity, said first air duct including a hot air outlet in said door and said second air duct including an exhaust air inlet in said door.

2. The washer/dryer combination of claim 1 further comprising a heater and blower unit for blowing hot air into said chamber of said body via said hot air outlet, said unit disposed within said body.

3. The washer/dryer combination of claim 2 further comprising a first air conduit having a first end and a second end, said first air conduit being disposed within said body, said first end matingly engaging said heater and blower unit and said second end matingly engaging said first air duct of said door.

4. The washer/dryer combination of claim 3 further comprising a second air conduit having a first end and a second end, said second air conduit disposed within said body, said first end of said second air conduit matingly engaging said second air duct in said door.

5. The washer/dryer combination of claim 4 further comprising a lint guard disposed within said second air conduit.

6. The washer/dryer combination of claim 1 further comprising at least one seal provided between said door and said opening of said front side of said body.

7. A washer/dryer combination comprising:

a body comprising a top end, a bottom end, a front side, a back side, a left side, a right side, a treatment chamber defined within said body, said front side including an opening;

a door attached to said front side and selectively covering said opening, said door comprising:

a front wall, a back wall, and a cavity defined between said front wall and said back wall;

a pair of air ducts disposed within said cavity, said first air duct including a hot air outlet in said door and said second air duct including an exhaust air inlet in said door;

a heater and blower unit for blowing hot air into said chamber via said hot air outlet, said unit disposed within said body;

a first air conduit having a first end and a second end, said first air conduit being disposed within said body, said first end of said first air conduit matingly engaging said heater and blower unit and said second end matingly engaging said first air duct;

a second air conduit having a first end and a second end, said second air conduit being disposed within said body, said first end of said second air conduit matingly engaging said exhaust air inlet in said door.

8. The washer/dryer combination of claim 7 further comprising a lint guard disposed within said second air conduit.

9. The washer/dryer combination of claim 7 further comprising at least one seal provided between said door and said opening of said front side of said body.

10. A washer/dryer combination comprising:

a body comprising a plurality of wall enclosing a treatment chamber, one of said walls including a first opening which communicates with said treatment chamber, another one of said walls including a second opening, wherein said second opening communicates with said treatment chamber;

a door attached to said one of said plurality of walls and selectively covering said first opening, said door comprising a third opening disposed within said door, said third opening communicating with said treatment chamber; and, wherein one of said second opening and said third opening comprises a hot air outlet communicating with said treatment chamber and another of said second opening and said third opening comprises an exhaust air inlet communicating with said treatment chamber.

11. The washer/dryer combination of claim 10 wherein said second opening located on said another one of said walls comprises said exhaust air inlet.

12. The washer/dryer combination of claim 11, wherein said third opening in said door comprises said hot air outlet.

13. The washer/dryer combination of claim 12 further comprising a heater and blower unit for blowing hot air into said chamber of said body via said hot air outlet, said unit being disposed within said body.

14. The washer/dryer of claim 10 further comprising a treatment tub located in said treatment chamber.

15. The washer/dryer of claim 10 wherein said door includes a window for viewing said treatment chamber.

16. The washer/dryer of claim 10 further comprising a lint filter disposed in a conduit communicating with said exhaust air inlet.

17. The washer/dryer of claim 16 further comprising a handle for said lint filter, said handle being accessible from one of said walls of said body for removal of said lint filter from said conduit.

18. The washer/dryer combination of claim 10 further comprising at least one seal provided between said door and said first opening of said body.

* * * * *